US006328863B1

(12) United States Patent
Wilhelm et al.

(10) Patent No.: US 6,328,863 B1
(45) Date of Patent: Dec. 11, 2001

(54) SPIRAL FEED AND DISCHARGE MANIFOLD FOR ELECTROLYTIC CELLS

(76) Inventors: Robert L. Wilhelm, 543 State Rd., Geneva, OH (US) 44041; William A. Nutter, 7660 Primrose Dr., Mentor, OH (US) 44060

( * ) Notice: Subject to any disclaimer, the term of this patent is extended or adjusted under 35 U.S.C. 154(b) by 0 days.

(21) Appl. No.: 09/365,761

(22) Filed: Aug. 3, 1999

Related U.S. Application Data

(60) Provisional application No. 60/096,182, filed on Aug. 11, 1998.

(51) Int. Cl.[7] ..... C25B 15/08

(52) U.S. Cl. ..... 204/254; 204/255; 204/256; 204/279; 210/321.75; 210/456

(58) Field of Search ..... 204/254, 255, 204/256, 279; 210/321.75, 456

(56) References Cited

U.S. PATENT DOCUMENTS

| | | | | |
|---|---|---|---|---|
| 3,421,996 | | 1/1969 | Coval et al. . | |
| 3,717,505 | | 2/1973 | Unkle, Jr. et al. . | |
| 5,454,951 | * | 10/1995 | Hoopman | 210/650 |
| 5,490,927 | * | 2/1996 | Herczeg | 210/321.84 |

FOREIGN PATENT DOCUMENTS

| | | |
|---|---|---|
| 2 114 043 | 6/1972 | (FR) . |
| 81 00863 | 4/1981 | (WO) . |

* cited by examiner

*Primary Examiner*—Arun S. Phasge

(57) ABSTRACT

A bipolar electrolytic cell can include, as a manifold, a spiral manifold assembly. This spiral manifold assembly will comprise a first outer assembly member, a second outer assembly member and a center assembly member. The overall structure can provide reduced loss of metal or gas and minimal loss of electrical current during an electrolytic process.

28 Claims, 8 Drawing Sheets

SPIRAL FEED AND DISCHARGE MANIFOLD FOR ELECTROLYTIC CELLS

CROSS REFERENCE TO RELATED APPLICATION

This application claims the benefit of U.S. Provisional Application No. 60/096,182 filed Aug. 11, 1998.

BACKGROUND OF THE INVENTION

1. Field of Invention

The present invention relates to apparatus for the feed and discharge of brine, caustic or other liquid and gas to and from an electrolytic cell. The apparatus design allows for minimal loss of electrical current during the electrolytic process and reduces or eliminates the loss of metal or gases produced from structures adjoining the electrolytic cell.

2. Description of the Related Art

Electrolytic cells are generally placed in commercial use for the production of chlorine, chlorates, chlorites, hydrochloric acid, hydrogen and other related chemicals, such as caustic solutions. Over the years, electrolytic membrane cells have undergone continuous development, e.g., improved operating efficiencies and improved lifetimes for cell components. This is often accomplished by continual design improvements.

Generally, such electrolytic cells will contain an external manifold. This manifold is provided with long feed and discharge tubes to reduce the amount of current leakage. For example, there has been shown in U.S. Pat. No. 4,738,763 external manifolds which are positioned on opposite ends of an anode or cathode pan. Flexible external tubing with screwed or flanged connections provide a path of travel for liquids and gas.

It would, nevertheless, be desirable to provide a manifold structure for a bipolar electrolyzer without the necessity for external feed and discharge tubes. It would also be desirable to provide a manifold structure capable of reducing or eliminating the loss of gas from adjoining structures.

SUMMARY OF THE INVENTION

There has now been developed a spiral feed and discharge manifold for bipolar electrolytic cells which is capable of minimizing the amount of electrical current lost in the electrolysis process and reducing or eliminating the loss of gas from adjoining structures. Additionally, the manifold minimizes the effects of reverse currents produced during electrolyzer shutdowns or power outages and reduces internal pressure fluctuations of the cell. The manifold can also be assembled together with a special pan manifold, and this manifold may utilize innovative retaining means, all of which are disclosed herein. Moreover, the invention provides readily available means that may be used for distinguishing between anolyte and catholyte manifolds.

In one aspect, the invention is directed to a spiral manifold assembly for a bipolar electrolyzer comprising:

a first outer assembly member having inner and outer ring members positioned at least substantially concentric one to the other and providing a central aperture within the inner ring member, a circumferential band member extending between and connecting to the ring members and having a front, at least substantially flat circumferential surface, a back circumferential surface having a recessed circumferential channel therein, a radial barrier member across the channel and a channel aperture adjacent the barrier member that penetrates through the band member;

a second outer assembly member spaced apart from the first outer assembly member and having inner and outer ring members positioned at least substantially concentric one to the other and providing a central aperture within the inner ring member, a circumferential band member extending between and connecting to the ring members and having a front, at least substantially flat circumferential surface, a back circumferential surface which has a recessed circumferential channel therein, a radial barrier member across the channel and an inwardly extending channel passageway adjacent the barrier member, which passageway extends from the recessed channel inwardly to the central aperture that is within the inner ring member; and a center assembly member, between the first and second outer assembly members, and comprising inner and outer ring members positioned at least substantially concentric one to the other and providing a central aperture within the inner ring member, a circumferential band member extending between and connecting to the ring members and having front and back circumferential surfaces, with each surface having a recessed circumferential channel therein, with a radial barrier member across each channel, with one recessed channel having an aperture through the band member and adjacent a barrier member, and one recessed channel having, adjacent a barrier member an inwardly extending channel passageway extending from the recessed channel inwardly to the central aperture that is within the inner ring member, the center assembly member being in releasible interengagement with the first and second outer assembly members.

In another aspect, the invention is directed to a pan manifold for an electrolytic cell, the pan and manifold assembly having front and back major faces with the front major face being substantially flat and having a flange extending along a perimeter of the front major face, an at least substantially circular top portion, an elongate bottom portion, and a central circular aperture extending through the front and back major faces at the top of the manifold, wherein the top portion terminates at a segment of its perimeter into an elongate bottom projecting from the top and providing parallel sides, which sides extend to form rounded corners.

In a still further aspect, the invention is directed to a bipolar electrolyzer assembly including a feed manifold and a discharge manifold, the improvement in the assembly comprising:

an anolyte discharge manifold of a first color; and a catholyte discharge manifold of a second color.

In yet another aspect, the invention is directed to a circular assembly member adapted for use in a spiral manifold assembly the assembly member having inner and outer, at least substantially concentric, ring members that provide a central aperture at the center of the inner ring member, and a connecting circumferential band member connecting the ring members, the circumferential band member having a front, at least substantially flat circumferential surface and a back circumferential surface, which back surface has a recessed, circular channel therein, plus a radial barrier member across the channel and a channel aperture adjacent the barrier member, which barrier member extends between, and connects to, the inner and outer ring members, and which channel aperture penetrates through the ring member.

In another aspect, the invention is directed to a circular assembly member adapted for use in a spiral manifold assembly, the assembly member having inner and outer, at least substantially concentric ring members that provide a central aperture at the center of the inner ring member, and a connecting circumferential band member connecting the ring members, the circumferential band member having a front, at least substantially flat circumferential surface and a back circumferential surface, which back surface has a recessed, circular channel therein plus a radial barrier member across said channel and a channel passageway adjacent the barrier member, which barrier member extends between and connects to the inner and outer ring members, and which passageway extends from the circular channel to the central aperture within the inner ring member.

In still a further aspect, the invention is directed to a circular, center assembly member adapted for use in a spiral manifold assembly, between first and second outer assembly members which center assembly member comprises inner and outer ring members positioned at least substantially concentric one to the other, with the inner ring member having a central aperture therethrough, a connecting circumferential band member connecting said ring members, and having front and back circumferential surfaces, with each surface having a recessed channel therein, with a radial barrier member across each channel, one barrier member having an adjacent aperture through the circumferential band member, and one barrier member having an adjacent passageway extending from the circular channel to the central aperture within the inner ring member, the center assembly member being adapted for releasable interengagement with the first and second outer assembly members.

Finally, the invention is directed to a bipolar electrolyzer assembly comprising:

a cathode assembly comprising a cathode, a spiral caustic feed manifold and a spiral catholyte discharge manifold;

an anode assembly comprising an anode, a spiral brine feed manifold and a spiral anolyte discharge manifold; and a separator between the cathode and the anode.

DESCRIPTION OF THE PREFERRED EMBODIMENT

Figure 1:
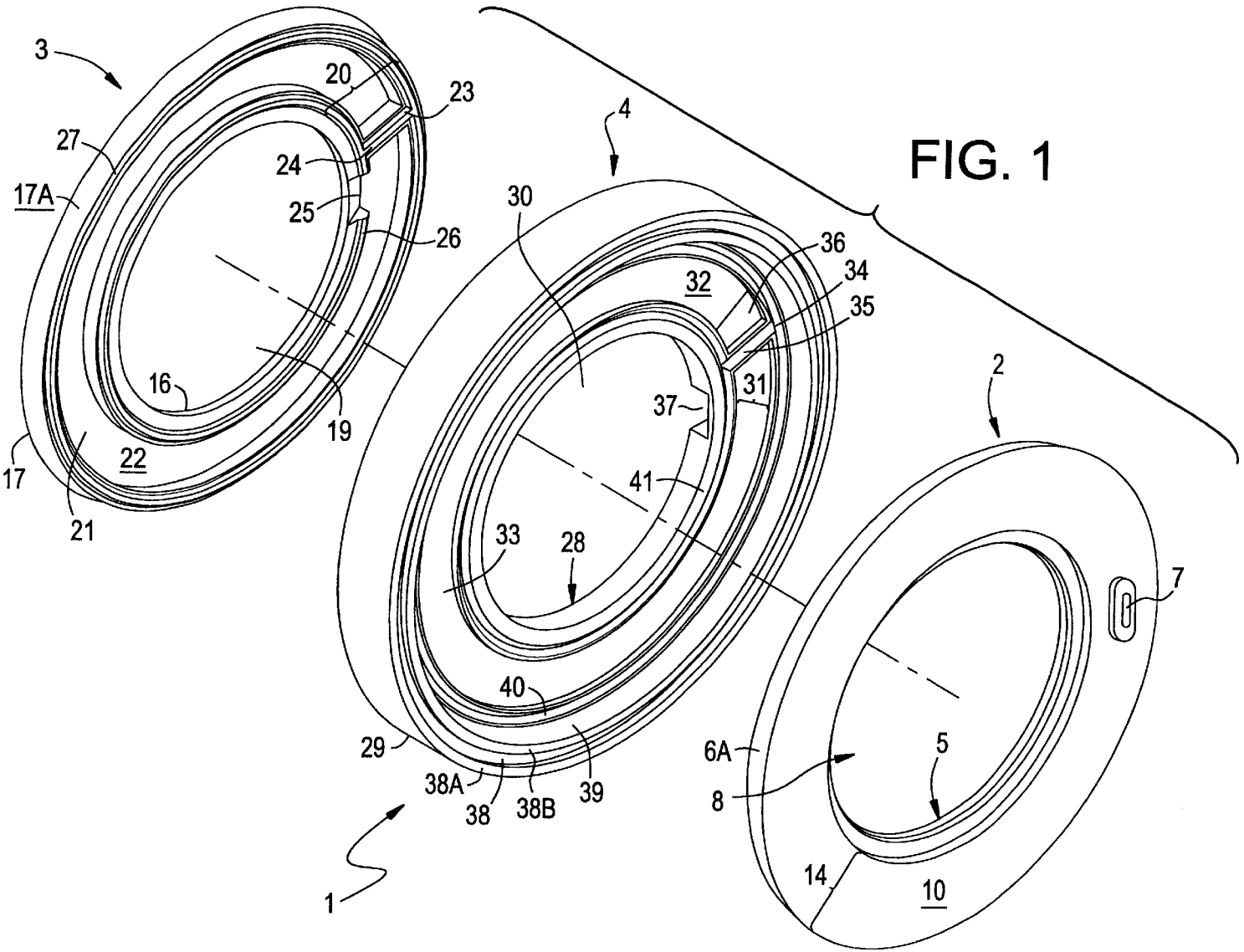
FIG. 1 is an exploded perspective view of a spiral discharge manifold assembly comprising a first outer assembly member, shown from its outer face, a center assembly member, and second outer assembly member, shown from its inner face.

Electrolytic cells employing the present invention can typically be useful for the electrolysis of a dissolved species contained in a bath, such as in electrolyzers employed in a chlor-alkali cell to produce chlorine and caustic soda or potassium hydroxide, or in an electrolysis process producing chlorate. Additionally, it is contemplated that the present invention may find use in electrolytic cells for the production of sulfuric acid, for salt splitting to regenerate acid and base values, or for electrolytic destruction of organic pollutants or water electrolysis or electroregeneration of catalytic intermediates or electrolysis of sodium carbonate or electro-organic synthesis.

For the materials of construction for the spiral manifold assembly, they will typically be electrically nonconductive, e.g., formed from a material such as a polymeric material. Suitable polymeric materials can include, but are not limited to, polypropylene, polytetraflouroethylene (PTFE), ethylene chlorotrifluoro-ethylene polymer (ECTFE), e.g., Halar (trademark), polyethylene, polyvinylidene fluoride (PVDF), e.g., Kynar (trademark), polyvinylchloride (PVC) or chlorinated polyvinyl chloride (CPVC). The material of the assembly, when serving as an anolyte discharge assembly, will preferably be PTFE or ECTFE. Also suitable for use for the anolyte discharge assembly is perfluoroalkoxy-resin (PFA). The material of the assembly, when serving as a cathode discharge assembly, will most always be CPVC. Other suitable materials may be acrylonitrile-butadiene-styrene resin (ABS), ethylene-tetra flouroethylene (ETFE), e.g., Tefzel (trademark), and flourinated ethylene-propylene resin (FEP), and dicyclopentadiende (DCPD).

These materials for the anolyte and catholyte discharge assemblies also provide the advantage of having distinguishing colors. In this manner, it is possible to differentiate between an anolyte discharge assembly and a catholyte discharge assembly where the anolyte discharge assembly is of a first color and the catholyte discharge assembly is of a second color. Where PTFE, ECTFE or PFA are utilized for an anolyte discharge assembly, the material will most always be white or a shade of white, including cream, tan or ivory. Where CPVC or other suitable materials are utilized for the catholyte discharge assembly, the materials will generally be gray or a shade of gray, such as charcoal gray, e.g., as determined by the amount of pigmenting with carbon black.

A polymeric material may also be suitable for the retainer and retainer clips that are utilized in the present invention, which articles will be more particularly discussed hereinbelow. Suitable polymeric materials for these articles may include polypropylene or polytetrafluoroethylene (PTFE). Additionally, it is contemplated that the retainer and retainer clips may be metallic. Suitable metals may include nickel or titanium.

The pan manifold of the present invention may be metallic, and useful metals include nickel and steel, as well as valve metals. The pan manifold, as a manifold for an anode assembly, will most always be a valve metal, including titanium, tantalum, zirconium and niobium. In particular interest for its ruggedness, corrosion resistance and availability is titanium. As well as the normally available elemental metals themselves, the suitable metals of the anode pan manifold can include metal alloys and intermetallic mixtures. For example, titanium may be alloyed with nickel, cobalt, iron,, manganese or copper. Where the pan manifold is to be utilized in a cathode assembly, a metal such as nickel or steel, including stainless steel, is most desirable.

Gasket members can be any resilient material typically useful for such service. These gasket materials can include polypropylene-polymerized with EPDM, e.g., Santoprene (trademark), neoprene, or the terpolymer from ethylene-propylene diene monomer (EPDM).

Referring then, to an embodiment of the present invention, as in FIG. 1, there is shown a spiral discharge manifold assembly 1. The assembly 1 consists of a first outer assembly member 2, a center assembly member 4 and a second outer assembly member 3. The first outer assembly member 2 includes inner 5 and outer 6 (FIG. 2) ring members which are in an at least substantially concentric configuration. The outer ring member 6 has an outer circumferential surface 6A. Extending between, and connected to, the inner 5 and outer 6 ring members is a circumferential member 14, sometimes referred to herein as a circumferential band member 14. It has front 10 and back (not shown) surfaces. The front surface 10 of the circumferential member 14 is an at least substantially flat surface, with there being a channel aperture 7 extending through the band member 14. At the center of the inner ring member 5 is a central aperture 8.

The second outer assembly member 3, then, comprises inner 16 and outer 17 ring members, with there being a central aperture 19 at the center of the inner ring member 16. The outer circumferential surface 17A of the outer ring member 17 is a beveled surface which conforms to engage with a canted surface (not shown) of the center assembly member 4. Disposed between and connecting with the inner 16 and outer 17 ring members is a circumferential band member 20. The circumferential member 20 has a front, flat surface (not shown) and a back surface 22. The front surface of the circumferential member 20, together with the inner 16 and outer 17 ring members form an essentially flat, common surface in the manner of the front surface 10 of the first outer assembly member 2. The back surface 22 of the circumferential member 20 is recessed from the inner 16 and outer 17 ring members. This recessing forms a circular channel 21 which contains a radial barrier member 23. Extending beyond the top surface of the radial barrier member 23 is a projecting member 24. This projecting member 24 interconnects with between and with ridges 26, 27 located along the back circumferential edges of the inner 16 and outer 17 ring members, respectively. Adjacent to the radial barrier member 23 is a channel passageway 25 which extends from the recessed circular channel 21 to the central aperture 19.

Between the first 2 and second 3 outer assembly members is a center assembly member 4. The center assembly member 4 has inner 28 and outer 29 ring members with a central aperture 30 through the center of the inner ring member 28. Along the circumference of the outer ring member 29 is a groove 38 positioned between first 38A and second 38B rims. This groove serves for the placement of a sealing means (not shown). Extending below the second rim 38B is a canted surface 39. This surface 39 conforms with the beveled outer surface 6A and of the first outer assembly member 2 respectively, thereby providing, on engagement, a snug fit, which can be a releasible inter engagement, between the outer assembly member 2, and center assembly member 4. The canted surface 17A performs a similar function for the second outer assembly member 3.

Between the inner 28 and outer 29 ring members, then, is a circumferential band member 31. The circumferential band member 31 has front 32 and back (not shown) circumferential surfaces. Each surface 32 of the circumferential ring member 31 encompasses a recessed channel 33 and an outer groove 40 in a circular arrangement. On each surface 32 and positioned radially in the recessed channel 33 between the inner 28 and outer 29 ring members of the center assembly member 4 is at least one radial barrier 34, with an adjacent channel aperture 36. Extending across the length of the barrier 34 is a radial groove 35. This radial groove 35 interconnects with a projecting member 13 (FIG. 2), of the first 2 outer assembly member. Additionally, located along the circumference of the inner ring member is an inner groove 41. This groove 41, then, together with the outer groove 40 of the circumferential member 31, interconnects with ridges 14, 15 (FIG. 2) at the back circumferential edges of the inner 5 and outer 6 ring members of the first assembly member 2, thereby providing a snug fit releasible interengagement between these assembly members 2, 4. On the back surface (not shown) of the center assembly member 4 is a channel passageway 37 which extends through the inner ring member 28.

Figure 2:
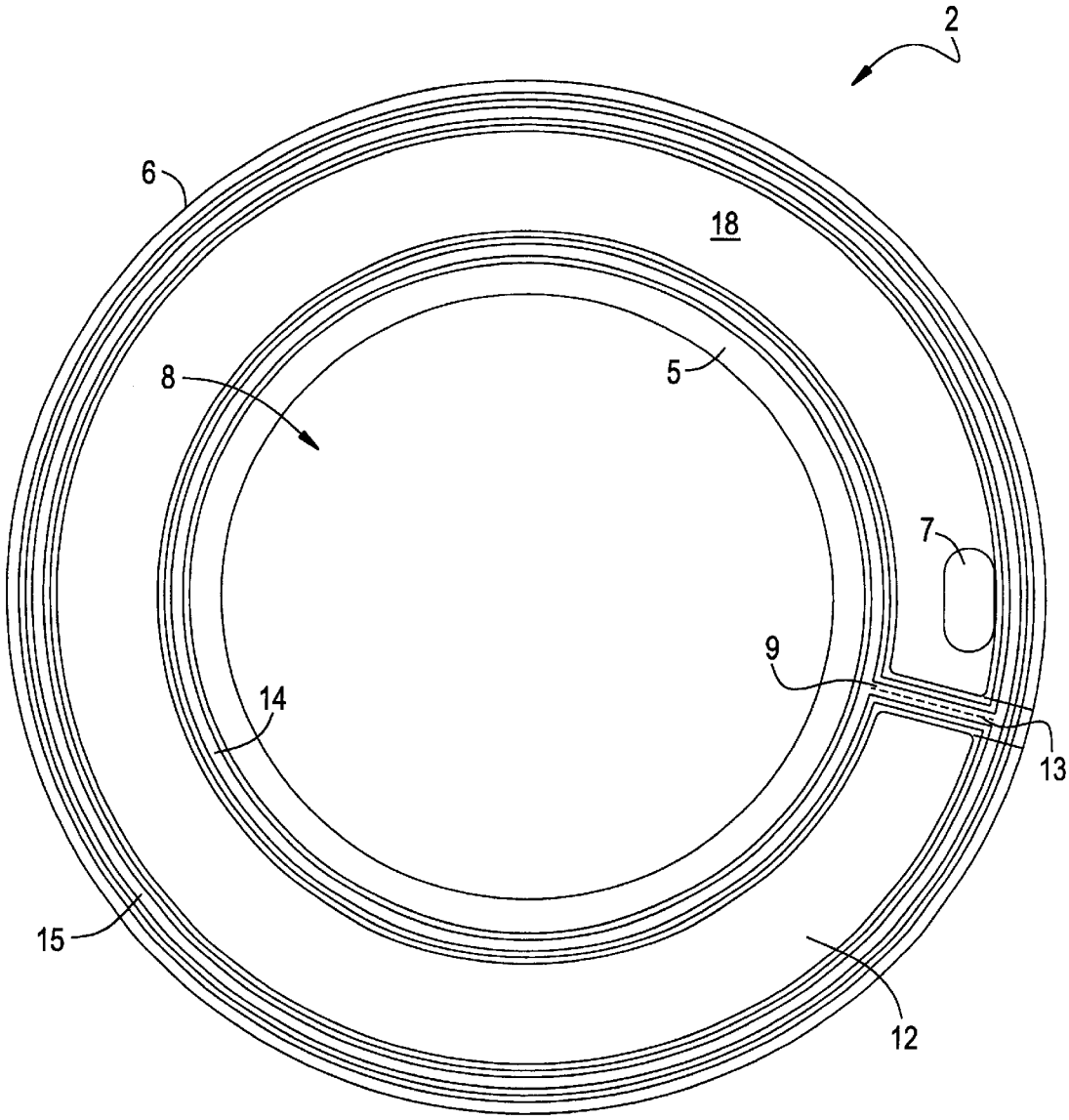
FIG. 2 is a plan view of the interior face of the first outer assembly member of FIG. 1.

In FIG. 2, there is then illustrated the back surface 18 of the first outer assembly member 2 of a discharge assembly 1 of the present invention. The back surface 18 of the first outer assembly member 2 comprises a recessed, circular channel 12. Across the width of the back surface 18 and extending between the inner 5 and outer 6 ring members is a radial barrier member 9. At the top of the radial barrier member 9 is a projecting member 13 jutting out from the barrier member 9. This projecting member 13 extends along the length of the barrier 9. Adjacent to the barrier member 9 is the channel aperture 7. Along the circumferential edges of the inner ring member 5 and the outer ring member 6 are ridges 14, 15 which project upwardly from the inner 5 and outer 6 ring members. These ridges 14, 15 of the inner 5 and outer 6 ring members, respectively, are positioned such that the ridges 14, 15 interconnect with the projection 13 of the radial barrier member 9. At the center of the inner ring member 5 is a central aperture 8.

Figure 3:
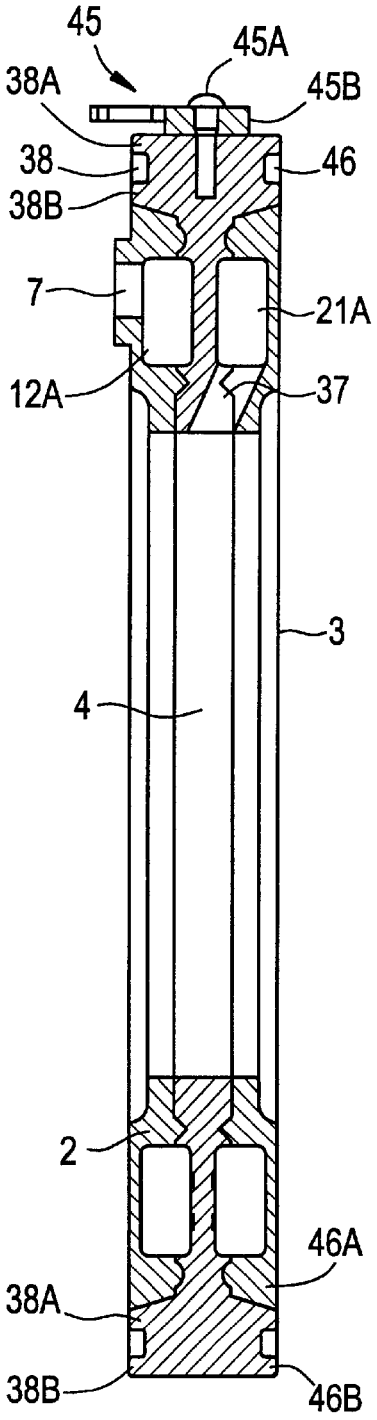
FIG. 3 is a sectional view of the discharge manifold assembly of FIG. 1.

Then, in FIG. 3, in cross section, there is depicted the spiral manifold assembly 1 of FIG. 1. Placement of the first outer assembly member 2, second outer assembly member 3 and center assembly member 4 in a sandwich-type arrangement thereby provides a first void 12A, formed from the recessed channel 12 of the first outer assembly member 2, together with the recessed channel 33 (FIG. 1) on the front surface 32 of the center assembly member 4. In the same manner, a second void 21A, is formed from the recessed channel 21 of the second outer assembly member 3 together with the recessed channel on the back surface (not shown) of the center assembly 4. The channel aperture 7 of the first outer assembly member 2, then, interconnects with the void 12A. Projecting from the second void 21A is the channel passageway 37 of the second outer assembly member 3. On the front (FIG. 1) of the center assembly member 4 is the groove 38 for a sealing means positioned between first and second rims 38A, 38B. Likewise, on the back surface of the center assembly member 4 is an identical groove 46 positioned between first and second rims 46A, 46B, also for a sealing means. Extending part way into the center assembly member 4 is a fastening means 45 comprising a fastener 45A and a retainer clip 45B. This fastening means 45 will be described hereinafter with reference to FIG. 8.

Figure 4:
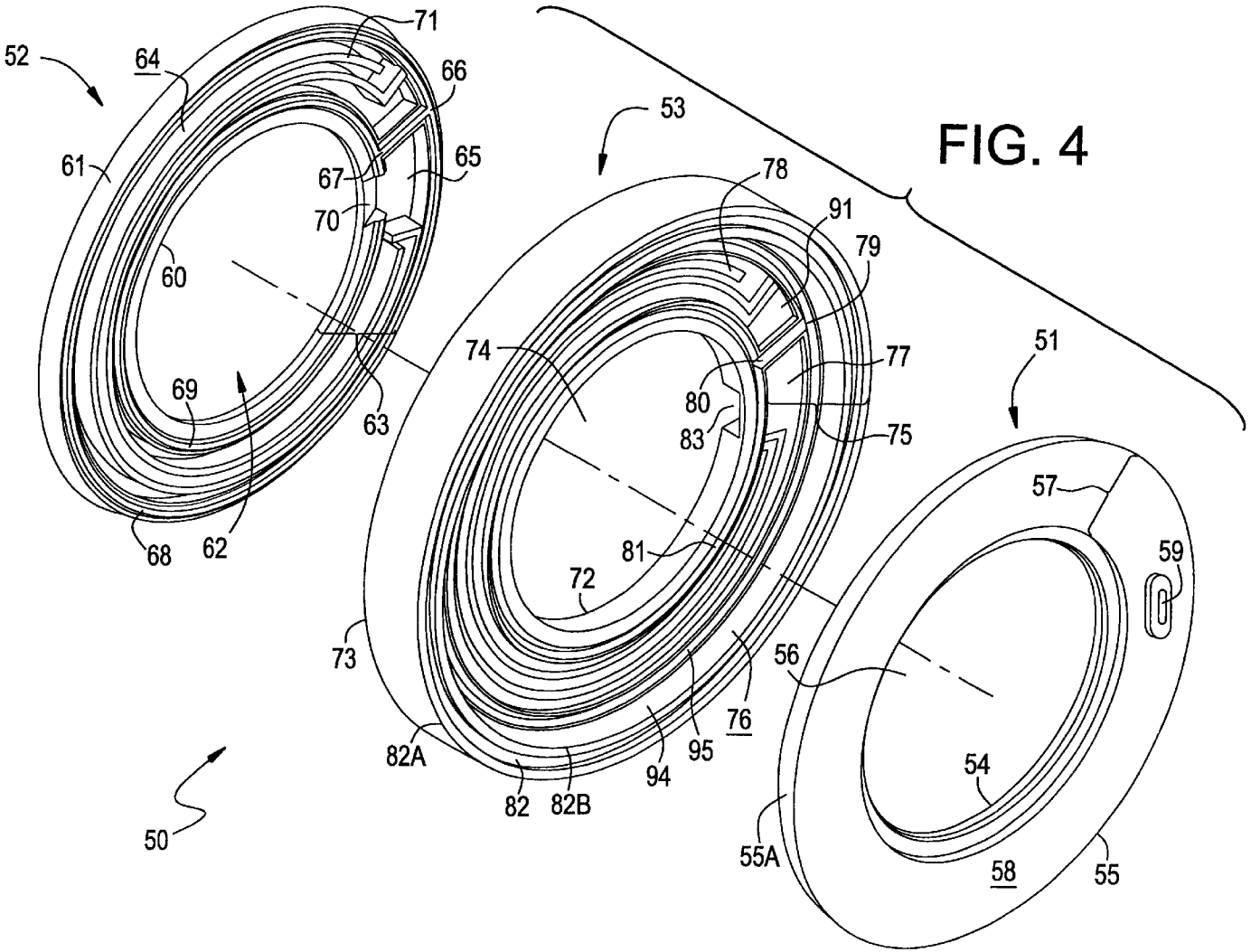
FIG. 4 is an exploded perspective view of a spiral feed manifold assembly having channel baffling, while comprising a first outer assembly member, center assembly member and a second outer assembly member.

Referring then to FIG. 4, there is shown a representative spiral feed manifold assembly 50. The assembly 50 essentially comprises components identical to the discharge assembly 1 of FIG. 1, i.e., a first outer assembly member 51, a second outer assembly member 52, and a center assembly member 53. The first outer assembly member 51 includes inner 54 and outer 55 ring members with a central aperture 56 at the center of the inner ring member 54. The outer surface 55A of the outer ring member 55 is a beveled surface 55A which conforms with the canted surface 94 of the center assembly member 53. Between the inner 54 and outer 55 ring members is a circumferential member 57. This circumferential member 57 has front 58 and back (not shown) surfaces. Along the front surface 58 is a channel aperture 59 which extends through the front 58 and back surfaces of the circumferential member 57.

The second outer assembly member 52 is essentially identical to the second outer discharge assembly member 3 of FIG. 1, comprising inner 60 and outer 61 ring members and a central aperture 62 at the center of the inner ring member 60. Between the inner 60 and outer 61 ring members is a circumferential member 63. The circumferential member 63 has a front, essentially flat surface (not shown) and a back surface 64. Along the back surface 64 is a recessed, circular channel 65. Extending across the circumferential member 63 and positioned within the recessed channel 65 is a radial barrier member 66, with an adjacent channel passageway 70 which extends from the recessed circular channel 65 to the central aperture 62. Extending upwardly along the surface of the radial barrier member 66 is a projecting member 67. This projecting member 67 interconnects with ridges 68, 69 located along each circumferential edge of the inner 60 and outer 56 ring members, respectively. Also located within the recessed channel 65 is at least one circumferential baffle means 71, usually referred to herein as "baffles 71". These baffles 71 are disposed at least substantially vertically, i.e., in a direction facing the center assembly member 53, within the recessed channel 65. While the second outer assembly member 52 of FIG. 4 is depicted as having two baffles 71, it is contemplated that such baffles may be established so as to provide a plurality of baffles, e.g., on the order of from 1 to 3 or more. These baffles 71 provide an increased distance for the circumferential flow of electrolyte within the assembly member 52, thereby reducing the electrical current leakage.

Disposed between the first outer assembly member 51 and the second outer assembly member 52 is a center assembly member 53. The center assembly member 53 has inner 72 and outer 73 ring members, and a central aperture 74 extending through the inner 72 ring member. Along the circumference of the outer ring member 73 is a groove 82 positioned between first 82A and second 82B rims. This groove serves for placement of a sealing means (not shown). Extending from the second rim 82B is a canted surface 94 which conforms with the beveled surface 55A of the first outer assembly member 51.

Positioned between the inner 72 and outer 73 ring members is a circumferential band member 75 having front 76 and back (not shown) circumferential surfaces. Each surface 76 encompasses a recessed channel 77 and an outer groove 95 in a circular arrangement. Within each recessed channel 77 is at least one recess baffle means 78. These recess baffles 78 are positioned centrally in the recessed channel 77 of the center assembly member 53. The recess baffle means 78 extend inwardly in order for the recess baffle 78 to engage baffles 71 and create a permanent seal.

Figure 5:
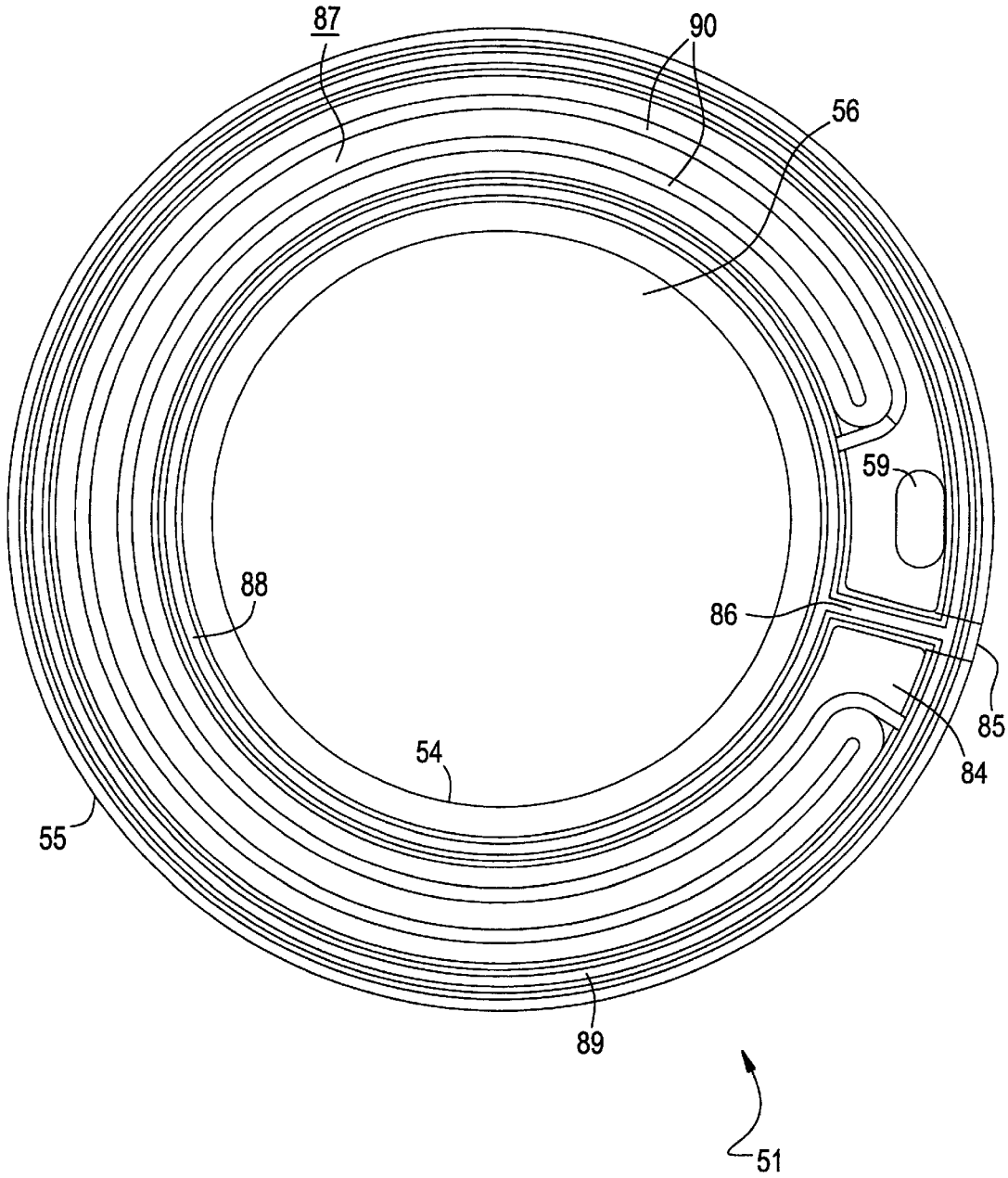
FIG. 5 is a plan view of the interior face of the first outer assembly member of FIG. 4.

On the surface of the band member 75 and positioned radially in the recessed channel 77 between the inner 72 and outer 73 ring members of the center assembly member 53 is at least one radial barrier member 79, with an adjacent channel aperture 99. Extending across the length of the barrier member 79 is a radial groove 80. This radial groove 80 interconnects with the barrier projecting member 86 (FIG. 5). The inner groove 81 positioned around the circumferential edge of the inner 72 ring member, interconnect with the inner ridge 88 (FIG. 5) while the outer groove 95 just inside the outer ring member 73 interconnects with the outer ridge 89 (FIG. 5). By these grooves 80, 81, 95 engagement with the ridges 86, 88, 89 (FIG. 5) of the first outer assembly member 51 there is provided a releasible interengagement between the first and center assembly members 51, 53. On the back surface (not shown) of the center assembly member 53 is a channel passageway 83 which extends through the inner ring member 72.

In preparing the spiral manifold assembly 50 of FIG. 4, both the front surface 76 and the back surface (not shown) of the center assembly member 53 are provided with recess baffle means 78 in equal quantities. By this it is meant that the number of recess baffle means 78 on the front surface 76 of the center assembly member 53 will be the same as the number of recess baffle means 78 on the back surface (not shown) of the center assembly member 53.

Alternatively, it is within the scope of the present invention that the number of recess baffle means on the front 76 face of the center assembly member 53 may be different from such means on the back face thereof. For example, where there may be two recess baffle means 78 on the front surface 78, there may more than two on the back surface. Additionally, a surface such as a front surface 78 may have recess baffle means 78, while another surface such as the back surface has no recess baffle means 78.

In FIG. 5 is shown the back surface 87 of the first outer assembly member 51 of FIG. 4. The back surface 87 of the first outer assembly member 51 comprises a recessed, circular channel 84. Across the back surface 87 of the circumferential band member 57 (FIG. 4) and extending between the inner 54 and outer 55 ring members is a radial barrier member 85. On the top of the radial barrier 85 and extending along the barrier's 85 length is a projecting member 86 jutting out from the barrier member 85. Adjacent to the barrier member 85 is the channel aperture 59. Along the circumference of the inner ring member 54 and the outer 55 ring members are ridges 88, 89 which project upwardly, i.e., toward the center assembly member 53, from the inner 54 and outer 55 ring members. These ridges 88, 89 of the inner 54 and outer 55 ring members, respectively, are positioned such that the ridges 88, 89 interconnect with the projecting member 86 of the radial barrier 85. Disposed within the recessed channel 84 of the first outer assembly member 51 in an at least substantially upwardly projecting manner are circumferential baffles 90. At the center of the inner ring member 54 is a central aperture 56.

Figure 6:
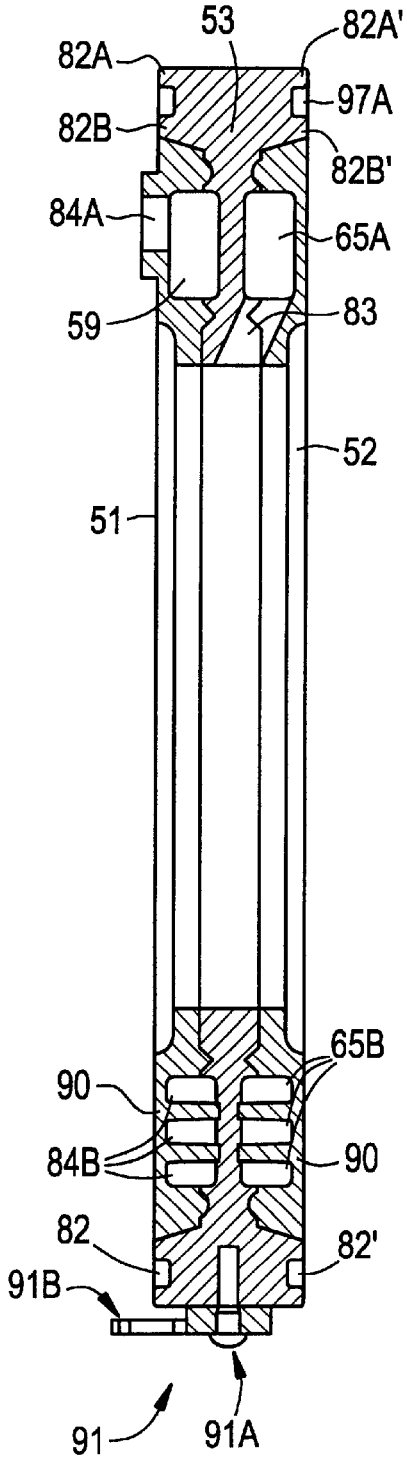
FIG. 6 is a sectional view of the spiral feed manifold assembly of FIG. 4.

Then, in FIG. 6, in cross section, there is depicted the spiral manifold assembly 50 of FIG. 4. Placement of the first outer assembly member 51, second outer assembly member 52 and center assembly member 53 is in a sandwich-type arrangement. This creates a first void 84*a* formed from the recessed channel 84 of the first outer assembly member 51, together with the recessed channel 77. The recess baffle means 78 (FIG. 4) on the front surface 76 of the center assembly member 53 divides this first void 84A into first void channels 84B. The channel aperture 59 of the first outer assembly member 51, then, interconnects with the first void 84A. In the same manner, a second void 65A, is formed from the circular channel 65 of the second outer assembly member 52 together with the recessed channel on the back surface (not shown) of the center assembly 53. The second void 84A is divided into second void channels 65B by the recess baffle means 71. Projecting from the second void 65A is the channel passageway 83 of the second outer assembly member 52. On the front surface 76 (FIG. 4) of the center assembly member 53 is the groove 82 positioned between first and second rims 82A, 82B for a sealing means. Likewise, on the back surface (not shown) of the center assembly member 53 is an identical groove 82' for a secondary sealing means positioned between first and second rims 82A' and 82B'. Extending part way into the center assembly member 53 is a fastening means 91 comprising a fastening means 91A, e.g., a bolt or a screw fastener, and a retainer clip 91B.

The first outer assembly member 2, center assembly member 4 and second outer assembly member 3 can then be assembled together. It is contemplated that the members 2, 3, 4 may be glued or welded. For example, where the assembly members 2, 3,4 are constructed of chlorinated polyvinyl chloride (CPVC), the members 2, 3, 4 may be assembled as with a CPVC glue. It is further contemplated that the members 2, 3, 4, may be held in a releasable interengagement as by mechanical fastening means, e.g., a bolt or screw fastener, and a retainer clip. Additionally, it is contemplated that the members 2, 3, 4 may be sealed together, as with a silicon compound.

Figure 7:
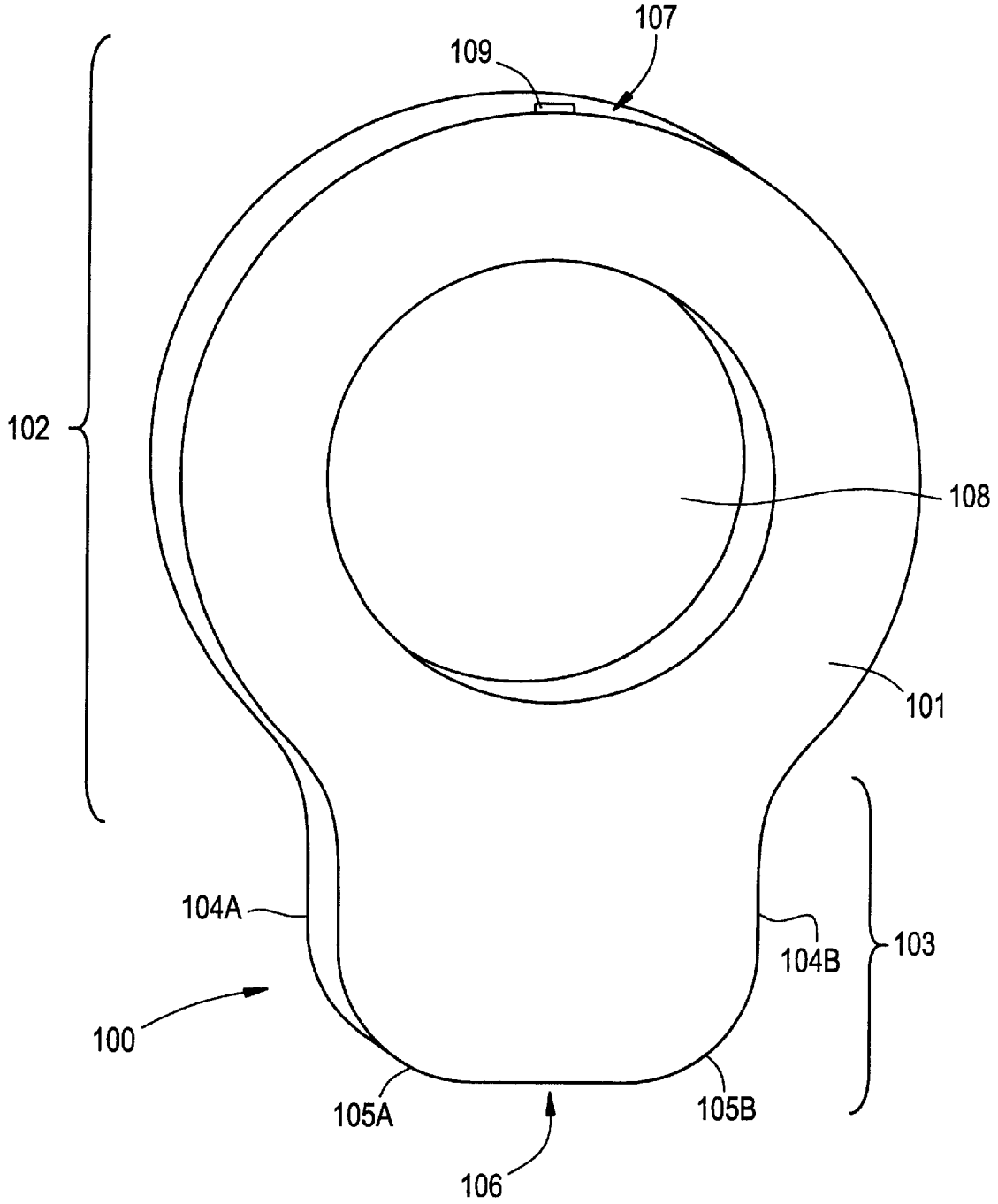
FIG. 7 is a plan view of a pan manifold of the invention.

In FIG. 7 there is provided a representative pan manifold 100 to be used with a manifold assembly 1. This pan manifold 100 has a major front face 101 as well as a major back face (not shown) and top 102 and bottom 103 portions. The top portion 102 is an essentially circular portion, with the bottom portion 103 having elongate sides 104A, 104B and extending from the top portion 102 at a segment of the top portion's 102 perimeter. The elongate sides 104A, 104B extend to form rounded corners 105A, 105B which converge to form a flat base 106. The major front face 101 is essentially flat, with a flange 107 extending along the perimeter of the front face 101. The top portion 102 has an enlarged central aperture 108 which extends through the pan manifold 100. Means for securing the spiral manifold assembly 1 to the pan manifold 100 includes retainers 109A, 109B, 109C. The retainers 109A, 109B, 109C are disposed equidistantly along the flange 107 of the top portion 102 of the pan manifold 100 and project upward from the flange 107. It will be understood that terms such as "top" and "bottom" are words of convenience used in describing the position of the manifold 100 as depicted in FIG. 7, but should not be construed as limiting the invention.

Figure 8:
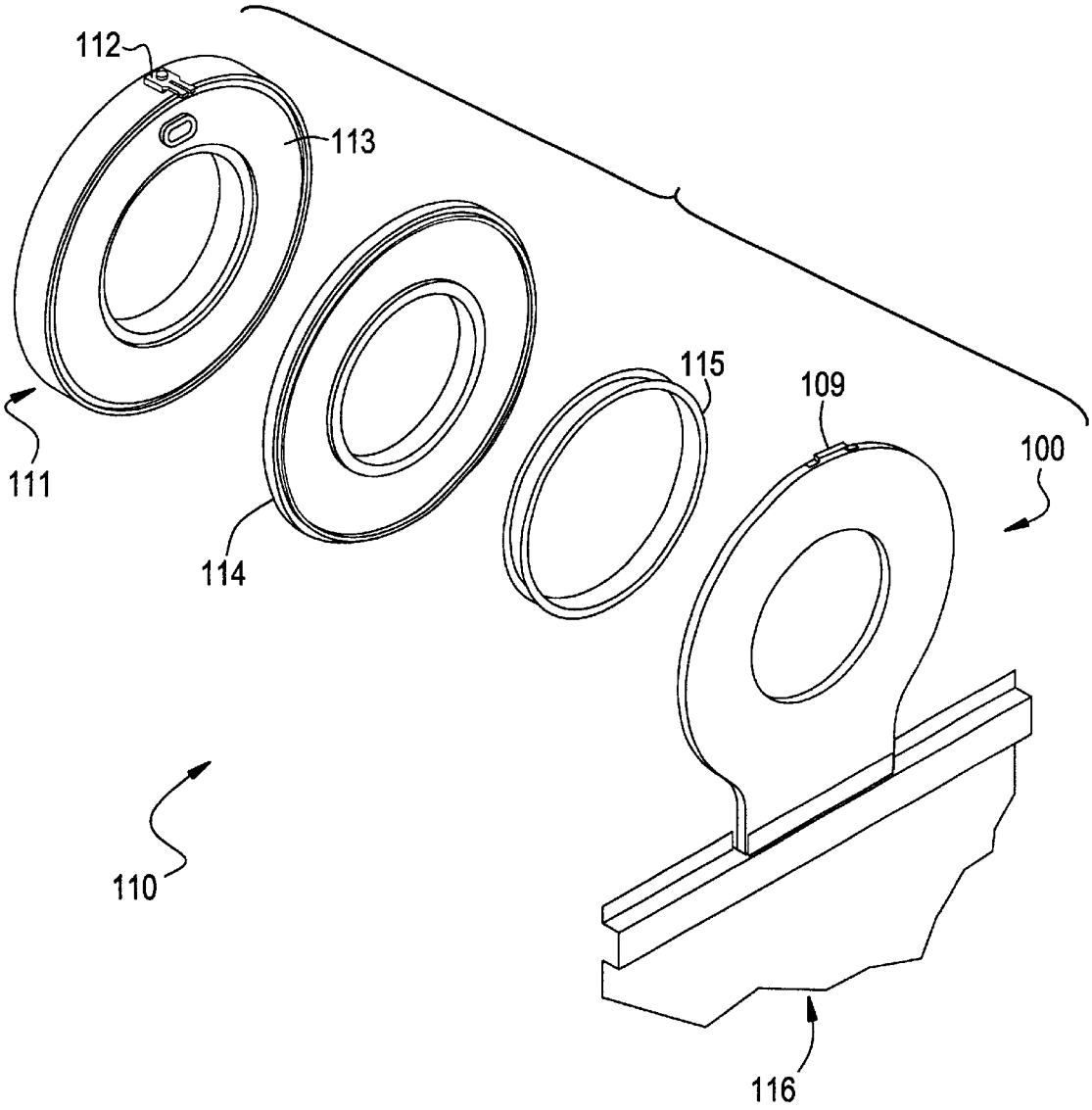
FIG. 8 is an exploded perspective view of a portion only of an electrode assembly, comprising a spiral manifold assembly and the pan manifold of FIG. 7.

In FIG. 8 there is presented an assembly 110 for use with a brine or caustic feed or anolyte or catholyte discharge manifold assembly. The assembly 110 comprises, generally, a spiral manifold 111 equipped with a retainer clip 112. Pressed against the front surface 113 of the spiral manifold assembly 111 may be a seal ring means. The seal ring means may comprise, as shown in FIG. 8, a circumferential gasket member 114. Where the assembly 110 is to be used in a spiral manifold for anolyte, a seal ring liner 115 may be necessary to prevent erosion of the gasket member 114. The seal ring liner 115 will most often be comprised of polytetrafluoroethylene (PTFE), ethylene chlorotrifluoro-ethylene polymer (ECTFE), or polyvinylidene fluoride (PVDF).

Pressed against, on a side opposite the spiral manifold 111, the seal ring gasket 114 is the pan manifold 100, which is connected to an electrode pan 116. Disposed equidistantly along the flange of the top portion 112 (FIG. 7) of the pan manifold 100, then, are retainers 109A, 109B, 109C. Upon connection of the assembly 110, a retainer clip 112 in corresponding position on the spiral manifold assembly 111 will snap into the retainer 109, thereby gripping the assembly 110 together.

Figure 9:
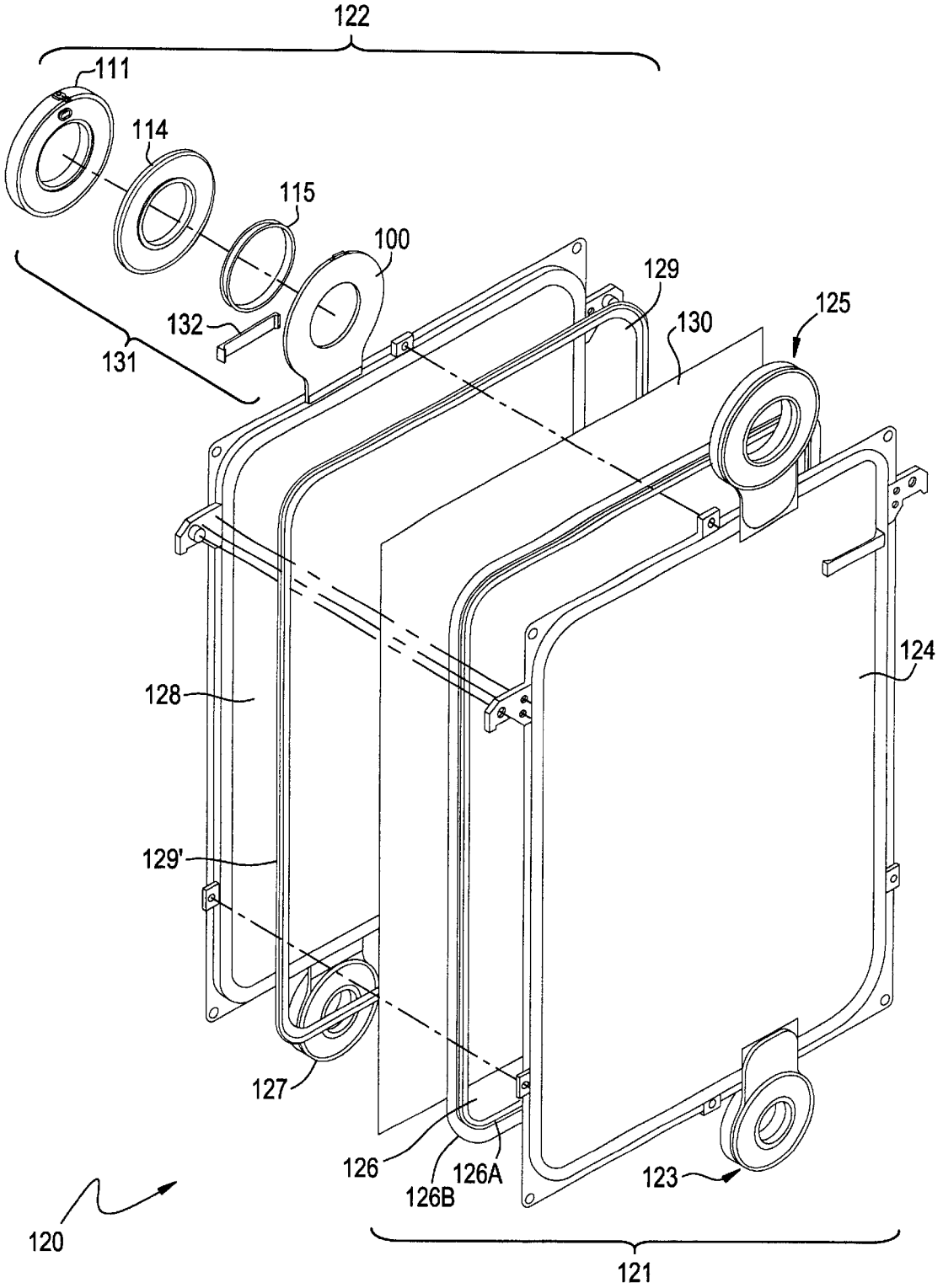
FIG. 9 is an exploded perspective view of a bipolar electrolyzer assembly having invention spiral manifolds and pan manifolds.

Referring, then, to FIG. 9, an electrolyzer cell assembly of particular interest as well as being representative of one aspect of the present invention comprises a bipolar cell assembly 120. Each bipolar cell assembly 120 has a cathode assembly 121 and an anode assembly 122. The cathode assembly 121 includes a spiral catholyte feed assembly 123 that is connected to a cathode pan 124.

This cathode pan 124, then, is connected at its opposite end to a spiral catholyte discharge assembly 125. Positioned adjacent to the catholyte pan 124 is a cathode pan gasket 126. The cathode pan gasket 126 is comprised of a circumferential gasket member 126A that is integral with a circumferential gasket frame 126B. For example, the gasket member 126A can be molded to the gasket frame 126B. On completing construction of the cathode assembly 121, the cathode pan gasket 126 is positioned against the cathode pan 124.

Referring, then, more particularly to the anode assembly 122, there is provided a spiral brine feed assembly 127 that is attached to an anode pan 128. As with the cathode pan 124, the anode pan 128 can be connected to the brine feed assembly 127. At the opposite end of the anode pan 128 there is provided a spiral anolyte discharge assembly 131. This anolyte discharge assembly 131 includes a spiral discharge assembly 111, a seal ring 114, a seal ring liner 115, a manifold gasket 132 and a pan manifold 100, as more particularly described hereinbefore with reference to FIG. 8. Adjacent to the anode pan 128 is an anode pan gasket 129 that is integral with a gasket frame 129'.

Between the anode assembly 122 and the cathode assembly 121 is a separator member 130. This separator member 130 may comprise a membrane or a diaphragm. Membranes suitable for use as a separator member can readily be of types which are commercially available. One presently preferred material is a perfluorinated copolymer having pendant cation exchange functional groups. These perfluorocarbons are a copolymer of at least two monomers with one monomer being selected from a group including vinyl fluoride, hexafluoropropylene, vinylidine fluoride, trifluoroethylene, chlorotrifluoroethylene, perfluoro (alkyvinyl ether), tetrafluoroethylene, and mixtures thereof.

The second monomer often is selected from a group of monomers usually containing an $SO_2F$ or sulfonyl fluoride pendent group. Examples of such second monomers can be generically represented by the formula $CF_2{=}CFR_1SO_1F$. $R_1$ in the generic formula is a bifunctional perfluorinated radical comprising generally one to eight carbon atoms, but upon occasion as many as twenty-five. One restraint upon the generic formula is general requirement for the presence of at least one fluorine atom on the carbon atom adjacent the $SO_2F$ group, particularly where the functional group exists as the —(—$SO_2NH$)mQ form. In this form, Q can be hydrogen or an alkali or alkaline earth metal cation and m is the valence of Q. The $R_1$ generic formula portion can be of any suitable or conventional configuration, but it has been found preferably that the vinyl radical comonomer join the $R_1$ group through an ether linkage.

Such perfluorocarbons generally are available commercially, such as through E. I. DuPont, their products being known generally under the trademark NAFION. Perfluorocarbon copolymers containing perfluoro (3, 6-dioxa-4-methyl-7-octenesulfonyl fluoride) comonomer have found particular acceptance.

It is also contemplated that the separator for the cell can be a diaphragm, which may sometimes be referred to herein as a "diaphragm porous separator". For the diaphragm in the cell assembly 120, a synthetic, electrolyte permeable diaphragm can be utilized. The synthetic diaphragms generally rely on a synthetic polymeric material, such as polyflouroethylene fiber as disclosed in U.S. Pat. No. 5,606,805 or expanded polytetraflouroethylene as disclosed in U.S. Pat. No. 5,183,545. Such synthetic diaphragms can contain a water insoluble inorganic particulate, e.g., silicon carbide, or zirconia, as disclosed in U.S. Pat. No. 4,606,805. Of particular interest for the diaphragm is the generally non-asbestos, synthetic fiber diaphragm containing inorganic particulates as disclosed in U.S. Pat. No. 4,853,101. The teachings of this patent are incorporated herein by reference.

Broadly, this diaphragm of particular interest comprises a non-isotropic fibrous mat wherein the fibers of the mat comprise 5–70 weight percent organic halocarbon polymer fiber in adherent combination with about 30–95 weight percent of finely divided inorganic particulates impacted into the fiber during fiber formation. The diaphragm has a weight per unit of surface area of between about 3 to about 12 kilograms per square meter. Preferably, the diaphragm has a weight in the range of about 3–7 kilograms per square meter. A particularly preferred particulate is zirconia. Other metal oxides, i.e., titania, can be used, as well as silicate, aluminates, ceramics, cermets, carbon, and mixtures thereof. Especially for this diaphragm of particular interest, the diaphragm may be compressed, e.g., at a compression of from about one to about 6 tons per square inch.

In operation of the spiral manifold assembly 1 of the present invention, electrolyte flows from a source (not shown) into the spiral manifold assembly 1 through the channel aperture 7 and enters the first void 12A (FIG. 3) of the recessed channels 12 (FIG. 2), 33 (FIG. 1) of the first outer assembly member 2 and center assembly member 4. Electrolyte then flows along a tortuous path that is initially, in a clockwise direction along the recessed channels 12, 33 and through the aperture 36 of the center assembly member 4. Then, in a counterclockwise direction, electrolyte continues through the second void 21A (FIG. 3) of the recessed channel 21 of the second outer assembly member 3 (FIG. 1) and the recessed channel (not shown) along the back of the center assembly member 4. Electrolyte then exits from the spiral manifold assembly 1 by way of the channel passageways 25, 37 of the second outer assembly member 3 and center assembly member 4. Similar considerations apply, but with a greater circumferential path of travel for the electrolyte in each outer assembly member plus center assembly member combination, for the spiral manifold assembly 50 of FIG. 4 having the recess baffles.

In a bipolar electrolyzer including spiral manifold assemblies of the present invention, electrolyte will flow into the spiral anolyte 127 and caustic 123 feed assemblies and travel through the assemblies 127, 123 in the manner described hereinbefore. Upon exit from the assemblies 127, 123, electrolyte will flow along the anode 128 or cathode 124 pans and into the spiral anode discharge 131 and cathode discharge 125 assemblies. Electrolyte flow, together with gas generated during cell operation, may then proceed to electrolyte recovery or processing means, e.g., recirculation means (not shown).

Upon assembly of the cathode assembly 121 and the anode assembly 122 together with a separator member 130, it is contemplated that these assemblies may be stacked as in a series arrangement to form an electrolyzer assembly. As depicted in FIG. 9, for each anode 122 and cathode 121 assembly, there is one anode 127 and cathode 123 spiral feed assembly and one anode 131 and cathode 125 spiral discharge assembly.

It has also been contemplated, for a bipolar electrolyzer, to refurbish the electrolyzer as by replacing conventional electrolyte feed means, e.g., long feed and discharge tubes, with the spiral manifold assembly 1 of the present invention. This could be accomplished by removing the feed and discharge tubes. Thereafter, the spiral manifold assembly 1 can be attached to a pan manifold 100, which is in turn mounted to anode 128 and cathode 124 pans.

The spiral manifold assembly may be any of a variety of shapes which are rounded, e.g., circles, ovals, as well as shapes which are multi-sided, including squares or rectangles. However in the application of the present invention and so as to provide ease of manufacture, the spiral manifold assembly will preferably be circular in shape.

What is claimed is:

1. A spiral manifold assembly for a bipolar electrolyzer comprising:

a first outer assembly member having inner and outer ring members positioned at least substantially concentric one to the other and providing a central aperture within said inner ring member, a circumferential band member extending between and connecting to said ring members and having a front, at least substantially flat circumferential surface, a back circumferential surface having a recessed circumferential channel therein, a radial barrier member across said channel and a channel aperture adjacent said barrier member that penetrates through said band member;

a second outer assembly member spaced apart from said first outer assembly member and having inner and outer ring members positioned at least substantially concentric one to the other and providing a central aperture within said inner ring member, a circumferential band member extending between and connecting to said ring members and having a front, at least substantially flat circumferential surface, a back circumferential surface which has a recessed circumferential channel therein, a radial barrier member across said channel and an inwardly extending channel passageway adjacent said barrier member, which passageway extends from said recessed channel inwardly to said central aperture that is within said inner ring member; and a center assembly member, between said first and second outer assembly members, and comprising inner and outer ring members positioned at least substantially concentric one to the other and providing a central aperture within said inner ring member, a circumferential band member extending between and connecting to said ring members and having front and back circumferential surfaces, with each surface having a recessed circumferential channel therein, with a radial barrier member across each channel, with one recessed channel having an aperture through said band member and adjacent a barrier member, and one recessed channel having adjacent a barrier member, an inwardly extending channel passageway extending from said recessed channel inwardly to said central aperture that is within said inner ring member, said center assembly member being in releasible interengagement with said first and second outer assembly members.

2. The spiral manifold assembly of claim 1 wherein said outer ring member of one or more of said first and second outer assembly members have an outer circumferential surface that is a beveled surface.

3. The spiral manifold assembly of claim 1 wherein said inner and outer ring member of one or more of said first and second outer assembly members further comprise circumferential edges facing toward said center assembly member and at least one edge has a ridge thereon extending toward said center assembly member.

4. The spiral manifold assembly of claim 3 wherein said radial barrier member of one or more of said first and second outer assembly members further comprises a projection at an edge of said radial barrier member facing said center assembly member and said projection of said radial barrier member interconnects with said ridges of said inner and outer ring members.

5. The spiral manifold assembly of claim 1 wherein said center assembly member further comprises a groove between first and second rims that extend around a circumference of said center assembly member.

6. The spiral manifold assembly of claim 1 wherein said radial barrier member of said center assembly member further comprises a groove extending across a top surface of said barrier and said groove interconnects with a projection of said radial barrier member of said first outer assembly member.

7. The spiral manifold assembly of claim 1 wherein said circumferential member of said center assembly member further comprises an outer groove, and said outer groove interconnects with a ridge extending along a circumference of said outer ring member.

8. The spiral manifold assembly of claim 1 wherein said inner ring member of said center assembly member further comprises an inner circumferential groove and said inner groove of said inner ring member interconnects with a ridge extending along a circumference of said inner ring member.

9. The spiral manifold assembly of claim 1 wherein said center assembly member further comprises at least one baffle recess means between said inner and outer ring members and said first outer assembly member channel aperture is an elongate, oval-shaped aperture.

10. The spiral manifold assembly of claim 1 wherein said spiral manifold is a discharge manifold that is one or more of a catholyte and anolyte discharge manifold, or said spiral manifold is a feed manifold that is one or more of a catholyte and anolyte feed manifold.

11. The spiral manifold assembly of claim 10 wherein said first and second assembly members further comprise at least one baffle positioned circumferentially within said assembly and situated in said recessed channel.

12. The spiral manifold assembly of claim 1 wherein said spiral manifold is comprised of a polymeric material selected from the group consisting of polypropylene, polytetrafluoroethylene, polyethylene, polyvinylidene fluoride, polyvinylchloride, chlorinated polyvinyl chloride, ethylene chlorotrifluoro-ethylene, acrylonitrile-butadiene-styrene, perfluoroalkoxy-resin, ethylene-tetra flouroethylene, and fluorinated ethylene-propylene resin.

13. The spiral manifold assembly of claim 1 wherein said spiral manifold further comprises sealing means, said sealing means comprises a gasket and said gasket is comprised of a material selected from the group consisting of neoprene, the terpolymer from ethylene-propylene diene monomer, and ethylene-propylene diene monomer polymerized with polypropylene.

14. The spiral manifold assembly of claim 1 wherein said first outer assembly member, said second outer assembly member and said center assembly member comprise a unitized article.

15. The spiral manifold assembly of claim 1 wherein said assembly members are formed by injection molding or machining.

16. A circular assembly member adapted for use in a spiral manifold assembly said assembly member having inner and outer, at least substantially concentric, ring members that provide a central aperture at the center of said inner ring member, and a connecting circumferential band member connecting said ring members, said circumferential band member having a front, at least substantially flat circumferential surface and a back circumferential surface, which back surface has a recessed, circular channel therein, plus a radial barrier member across said channel and a channel aperture adjacent said barrier member, which barrier member extends between, and connects to, said inner and outer ring members, and which channel aperture penetrates through said band member.

17. The assembly member of claim 16 wherein said radial barrier further comprises a projection extending upwardly from and across said radial barrier, said aperture adjacent said radial barrier is an elongated, oval-shaped aperture, and said outer ring member has an outer circumferential surface that is a beveled surface.

18. The spiral manifold assembly of claim 16 wherein said inner and outer ring members each have at least one circumferential edge and at least one edge has a projecting edge.

19. The assembly member of claim 16 wherein said ring member is comprised of a polymeric material selected from the group consisting of polyvinylchloride, chlorinated polyvinylchloride, polytetraflourethylene, and polyvinylidene fluoride.

20. A circular assembly member adapted for use in a spiral manifold assembly, said assembly member having inner and outer, at least substantially concentric ring members that provide a central aperture at the center of said inner ring member, and a connecting circumferential band member connecting said ring members, said circumferential band member having a front, at least substantially flat circumferential surface and a back circumferential surface, which back surface has a recessed, circular channel therein plus a radial barrier member across said channel and a channel passageway adjacent said barrier member, which barrier member extends between and connects to said inner and outer ring members, and which passageway extends from said circular channel to said central aperture within said inner ring member.

21. The assembly member of claim 20 wherein said radial barrier contains a projection extending upwardly from and across said radial barrier and said outer ring member has an outer circumferential surface that is a beveled surface.

22. The spiral manifold assembly of claim 20 wherein said inner and outer ring members each have at least one circumferential edge and at least one edge has a projecting ridge.

23. The assembly member of claim 20 wherein said assembly member is comprised of a polymeric material selected from the group consisting of polyvinylchloride, chlorinated polyvinylchloride, polytetraflourethylene, and polyvinylidene fluoride.

24. A circular, center assembly member adapted for use in a spiral manifold assembly, between first and second outer assembly members which center assembly member comprises inner and outer ring members positioned at least substantially concentric one to the other, with the inner ring member having a central aperture therethrough, a connecting circumferential band member connecting said ring members, and having front and back circumferential surfaces, with each surface having a recessed channel therein, with a radial barrier member across each channel, one barrier member having an adjacent aperture through said circumferential band member, and one barrier member having an adjacent passageway extending from said circular channel to said central aperture within said inner ring member, said center assembly member being adapted for releasable interengagement with said first and second outer assembly members.

25. The assembly member of claim 24 wherein said assembly member is positioned between, and in releasable interengagement with, a first outer assembly member and a second outer assembly member.

26. The assembly member of claim 24 wherein said radial barrier member further comprises a groove within a top surface of said barrier member.

27. The assembly member of claim 24 wherein said assembly member inner and outer ring members each have circumferential edges and at least one said edge further comprises a groove within said circumferential edge.

28. The assembly member of claim 24 wherein said center assembly member further comprises at least one circumferential baffle means positioned on a band member.

* * * * *